United States Patent [19]

Blackburn

[11] 4,240,024

[45] Dec. 16, 1980

[54] TEMPERATURE COMPENSATED CURRENT SOURCE

[75] Inventor: Tom L. Blackburn, San Jose, Calif.

[73] Assignee: GTE Automatic Electric Laboratories Incorporated, Northlake, Ill.

[21] Appl. No.: 12,254

[22] Filed: Feb. 15, 1979

[51] Int. Cl.[3] ..... G05F 3/20

[52] U.S. Cl. ..... 323/4

[58] Field of Search ..... 307/310; 323/1, 4

[56] References Cited

U.S. PATENT DOCUMENTS

| | | | |
|---|---|---|---|
| 3,617,859 | 11/1971 | Dobkin | 323/4 |
| 3,760,200 | 9/1973 | Taniguchi et al. | 307/310 |
| 4,004,247 | 1/1977 | Van de Plassche | 323/4 |
| 4,088,941 | 5/1978 | Wheatley | 323/8 |

OTHER PUBLICATIONS

101 Analog IC Designs, Interdesign, Inc., 1976, p. 32.

*Primary Examiner*—William H. Beha, Jr.
*Attorney, Agent, or Firm*—Russell A. Cannon

[57] ABSTRACT

An integrated current source comprising a discrete resistor having one side thereof electrically connected through a PNP transistor to a first DC supply voltage and through series connected base-emitter diodes of a first pair of NPN transistors to a temperature stable DC supply voltage. The other side of the resistor is electrically connected to ground through series connected base-emitter junctions of a second pair of NPN transistors, with the base emitter junctions of the first and second transistor pairs being poled in opposite directions. The NPN transistors are caused to have collector currents that make the base-emitter junction voltages cancel on opposite sides of the resistor. This causes the temperature stable supply voltage to be established across the resistor in order to set a reference current in it, and in an NPN transistor driving the load, that is substantially constant and independent of temperature.

16 Claims, 2 Drawing Figures

TEMPERATURE COMPENSATED CURRENT SOURCE

BACKGROUND OF INVENTION

This invention relates to current sources for transistor circuits and more particularly to a temperature compensated transistor current source that is suitable for manufacture in integrated circuit form.

Integrated current sources such as are described in chapter 4 of Analysis and Design of Analog Integrated Circuits by P. R. Gray and R. G. Meyer, John Wiley & Sons, 1977; section four of the booklet 101 Analog Integrated Circuit Designs by Interdesign; Inc., Sunnyvale, Calif., 1976; and U.S. Pat. No. 3,700,929, Oct. 24, 1972, Integrated Bi-Stable Circuit by T. M. Fredriksen, have been used in analog integrated circuits to make them less sensitive to power supply and temperature variations. In addition, improved temperature stability is provided by using a Zener diode to set a reference voltage in the current source. Although such a source is somewhat temperature compensated, it requires a supply voltage that must of necessity be greater than the Zener voltage, which may be greater than 7 volts. Temperature compensated integrated circuits are also described in U.S. Pat. Nos. 3,703,650, Nov. 21, 1972, by L. J. Kendall and 3,703,651, Nov. 21, 1972 by W. L. Blowers.

An object of this invention is the provision of an improved temperature compensated current source which is suitable for manufacture in integrated circuit form and which may operate from a supply voltage that is less than such a Zener voltage.

SUMMARY OF INVENTION

In accordance with this invention, one and other sides of a discrete resistor are electrically connected through the same number of series connected base-emitter junction diodes of transistors of the same conductivity type to a temperature stable DC supply voltage and a reference voltage, respectively, the one side of the resistor also being electrically connected to another DC supply voltage. The transistors on opposite sides of the resistor are poled in opposite directions. They are also caused to have base-emitter junction voltages that cancel on opposite sides of the resistor in the loop equation therethrough. This causes the voltage developed across the resistor, which also sets the reference current in it and in one of the transistors, to be substantially constant and independent of temperature.

DESCRIPTION OF PREFERRED EMBODIMENTS

Figure 1:
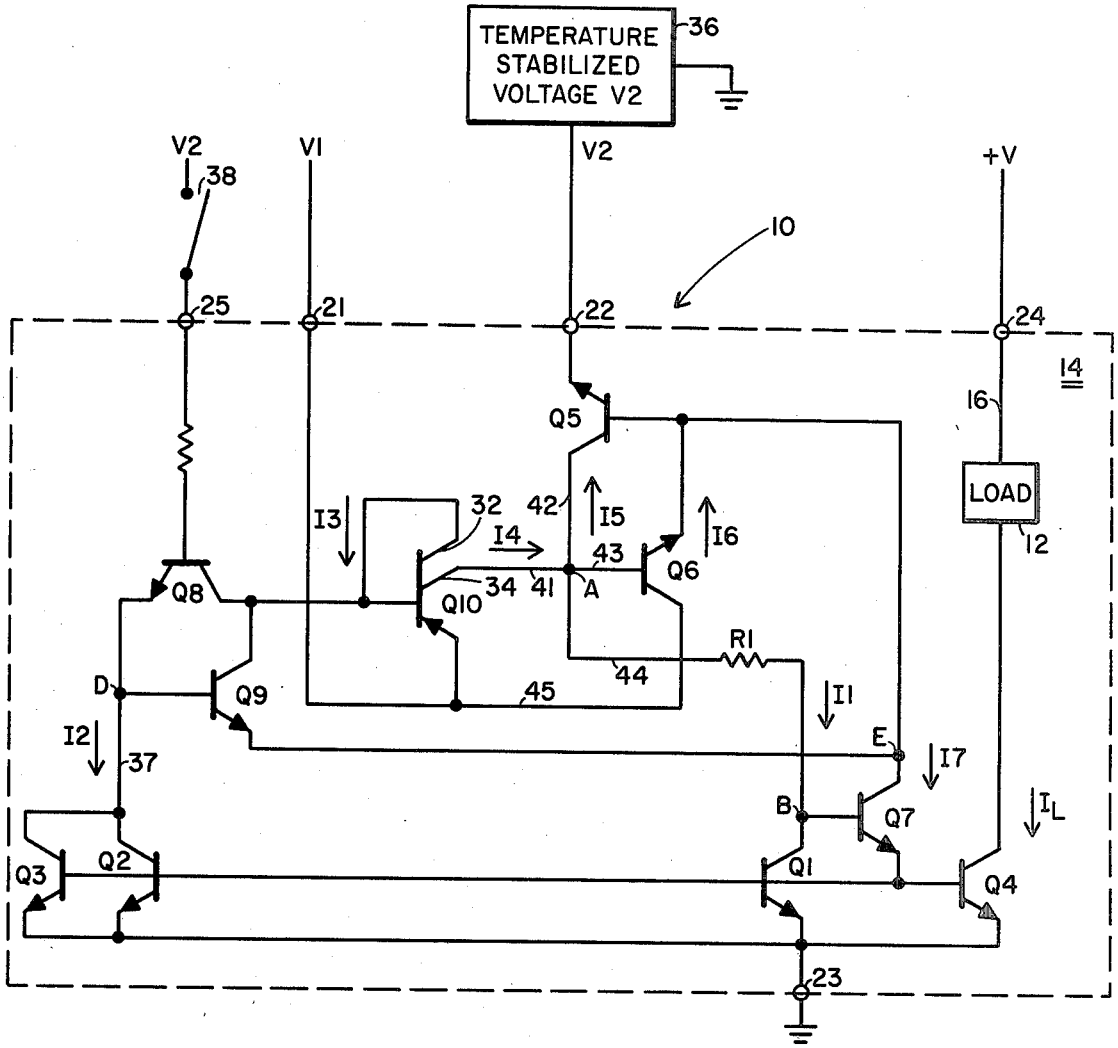
FIG. 1 is a schematic circuit diagram of a preferred embodiment of this invention.

Referring now to FIG. 1, there is shown an integrated current source 10 which provides a current $I_L$ for driving a load 12 which may, by way of example, be an integrated oscillator. The circuit components within the dashed lines (except for an external resistor R1) are formed as part of a monolithic integrated circuit which may include more components than are illustrated here.

The integrated current source 10 comprises a plurality of NPN transistors Q1–Q9 and a PNP transistor Q10 which are formed in a semiconductor chip 14. Bonding pads or terminals 21–25 are also attached to the substrate of the chip in which the integrated circuit 10 is formed for making connection to sources of DC supply voltages. The NPN transistors have current gains $\beta$ that are typically greater than 100 for emitter currents $I_E$ of 1 $\mu$A to 1 mA. They are also closely spaced together in the same orientation on the chip 14 so that they have closely matched characteristics. Recognizing that $$V_{BE}=(KT/q)ln(I_E/I_S) \quad (1)$$

where K and q are constants, T is temperature, $I_S$ is saturation current, $I_E=I_C$ for $\beta>50$, and $I_C$ is collector current, then the transistors will have the same base-emitter voltages $V_{BE}$ if they pass the same values of collector current. The PNP transistor Q10 is preferably a dual collector transistor for providing good matching of the characteristics of the two halves thereof.

In accordance with a preferred embodiment of this invention in FIG. 1, the PNP transistor Q10 has one collector 32 electrically connected to the base thereof and an emitter directly electrically connected to a first bonding pad 21 which is connected to a source of positive DC supply voltage V1. The other collector 34 of Q10 is directly electrically connected through node A to one side of the external resistor R1 which has a resistance that is substantially independent of temperature. This one side of R1 is also connected through the Q5 collector-emitter path to a second bonding pad 22 which is connected to a source 36 of temperature stabilized positive supply voltage V2, and through the Q6 base-emitter junction to the Q5 base. The Q6 collector is also connected to the bonding pad 21. Since the one side of R1 at node A is electrically connected to bonding pad 22 through the Q6 and Q5 base-emitter junction diodes, the voltage V1 is required to be greater than the voltage V2 by at least two base-emitter junction diode voltage drops as is described more fully hereinafter.

The NPN transistors Q1, Q2, Q3 and Q4 have their base electrodes electrically connected together and to the Q7 emitter, and have their emitter electrodes directly electrically connected to a third bonding pad 23 for connection to a third DC supply voltage which is a temperature stable ground reference potential. The Q4 collector is connected to the load 12 which has a line 16 extending to a bonding pad 24 for making connection to a suitable DC supply voltage. The Q1 collector is directly connected to the other side of R1 and to the base electrode of Q7 which has its collector connected to the Q6 emitter. The collector electrodes of Q2 and Q3 are connected through a control transistor Q8 to the base of Q10. When a switch 38 is closed to couple a positive control voltage V2 to bonding pad 25, the Q8 base-emitter junction is forward biased to enable Q8 to conduct, and the current source 10 to operate to provide a desired value of load current $I_L$ in Q4. Conversely, when switch 38 is open, Q8 is cut off and the current source 10 rendered inoperative. This operation is desirable where a minimum current drain is desired in an idle condition. A transistor Q9 is connected between the collectors of Q7 and Q8, with its base connected to node D to ensure start-up of the current source 10 when switch 38 is closed and for preventing the current source being driven into a zero current condition. When the current source is operational, Q9 is cut off since the voltages at nodes D and E are one base-emitter junction diode voltage drop below and above the voltage V2.

Consider that the switch 38 is closed so that the transistors conduct and a reference current I1 flows through R1. Since the integrated transistors are matched and have high current gain, the base currents thereof are negligible. This means that the collector current of Q1 is substantially equal to the reference current I1 so that the load current $I_L = I1$ and the current I2 = 2 I1 in line 37 for providing collector currents in Q2 and Q3 that are equal to the reference current. As was previously indicated, Q9 is cut off at this time so that the currents I3 and I4 passed by associated collector electrodes 32 and 34 of Q10 are also equal to twice the reference current I1. Since the base current in line 43 is negligible, the node equation for node A reveals that the Q5 collector current I5 flowing out of node A is also equal to the reference current I1. This means that the base-emitter junction diode voltages $V_{BE}$ of the transistors Q1 and Q5 are also the same values (see equation (1)). Reference to FIG. 1 also reveals that the same collector current I6 = I7 flows in transistors Q6 and Q7 to require the base-emitter junction diode voltage drops thereof to be substantially the same values.

In accordance with this invention, the sums of the base-emitter junction diode voltage drops between one and other sides of R1 and associated pads 22 and 23 are the same values and of opposite sense. This is expressed analytically as $$V2 + V_{BE5} + V_{BE6} - V_{R1} - V_{BE7} - V_{BE1} = 0 \quad (2)$$

by the loop equation for R1 and the transistors, where the subscript numerals designate particular transistors. Since the magnitudes of the $V_{BE}$ for Q5 and Q6 are the same as those for Q1 and Q7, respectively, equation (2) reduces to $$V_{R1} = V2 \quad (3)$$

This means that the stable voltage V2 is produced across the discrete resistor R1 so that the reference current I1 in R1 and Q1, and thus the load current $I_L$, are independent of any variation that may occur in the integrated transistors or circuit as a result of changes in ambient temperature.

Figure 2:
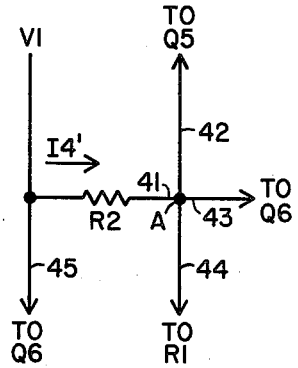
FIG. 2 is a schematic circuit diagram illustrating a modified form of the embodiment in FIG. 1.

Although this invention is described in relation to a preferred embodiment thereof, improvements and modifications will occur to those skilled in the art. By way of example, a current source embodying this invention may be provided using discrete transistors Q1–Q10 having closely matched conduction characteristics. Also, the dual collector PNP transistor means Q10 may be replaced by a pair of transistors having their emitter electrodes connected together, and having their base electrodes connected together and to one of the collector electrodes thereof. Further, the types of transistors and polarities of the supply voltages may be reversed. And the current source 10 may be driven from a double ended power supply. Additionally, the control transistor Q8 may be replaced by a short circuit between the Q3 collector and the Q10 base, where the amount of current drawn by the circuit 10 in an idle condition is of minor consequence. Alternatively, Q2, Q3, Q8, Q9 and Q10 may be replaced by a discrete resistor R2, having a resistance that is one-half that of R1, connected between node A and pad 21 as is illustrated in FIG. 2. The resistor R2 will also provide the desired current I4' = 2I1 into the node A. Also, the start-up transistor Q9 may be replaced by a large resistance connected between nodes D and E. Further, since values of both V2 and R1 are independent of temperature it is only necessary to specify the desired reference current I1 that is required and select a reasonable value of resistance for R1 which then sets the stabilized supply voltage V2. The scope of this invention is defined therefore by the appended claims rather than the aforementioned detailed description of preferred embodiments thereof.

What is claimed is:

1. A temperature compensated current source which is suitable for manufacture in integrated circuit form comprising:

first, second and third DC supply terminals;

a plurality of transistors of the same conductivity type;

a first resistor;

first means electrically connecting one end of said first resistor to said first terminal and through series connected base-emitter junction diodes of a prescribed number of ones of said transistors to said second terminal; and second means electrically connecting the other end of said first resistor through series connected base-emitter junction diodes of the same prescribed number of others of said transistors to said third terminal for establishing a voltage across said first resistor that is substantially constant and independent of temperature variations for setting a reference current in it and one of said other transistors when said terminals are connected to suitable supply voltages.

2. The source according to claim 1 wherein said first, second and third terminals are adapted for electrical connection to associated DC voltages, the second voltage being a temperature stable DC voltage measured with respect to and having a value between values of the other two voltages.

3. The source according to claim 2 wherein said current source is an integrated transistor current source, said transistors are integrated transistors formed on a common chip, and said first resistor is of discrete form and external to the chip.

4. The source according to claim 3 wherein said one and other transistors are of the same conductivity type, the base-emitter junction diodes of said one transistors being poled opposite to base-emitter junction diodes of said other transistors.

5. The source according to claim 4 wherein transistors in the paths between opposite ends of said first resistor and associated terminals are matched.

6. The source according to claim 4 wherein each of said one transistors is paired with an associated other transistor, the transistors in each pair being matched and passing collector currents of substantially the same value for causing the base-emitter junction voltages thereof to be substantially the same values.

7. The source according to claim 6 comprising first and second transistors which are one transistors and third and fourth transistors which are other transistors, each of said transistors having first, second and control electrodes, said first transistor's first and second electrodes being electrically connected in series between said second terminal and the one side of said first resistor with said second transistor's first and control electrodes being electrically connected between said first transistor's control electrode and said one side of said first resistor, said first means electrically connecting the second transistor's second electrode and said one side of said first resistor to the first terminal so as to provide a current into the junction of said first resistor and said first transistor's second electrode which is substantially twice the value of the reference current, said third transistor's first and second electrodes being electrically connected in series between said third terminal and said other side of said first resistor which is electrically connected to the control electrode of said fourth transistor which has its second and first electrodes electrically connected to the control electrodes of said first and third transistors, respectively.

8. The source according to claim 7 wherein said first means comprises a second discrete resistor, having a resistance that is one-half the resistance of said first resistor, in the electrical connection between the one side of said first resistor and said first terminal.

9. A temperature compensated transistor current source which is suitable for manufacture in integrated circuit form comprising:

a discrete resistor;

first, second and third DC supply terminals for electrical connection to associated DC voltages, said second terminal being adapted for electrical connection to a temperature stable DC voltage having a value that is between values of the other two voltages, one of which is a temperature stable reference voltage;

transistor pair means of one conductivity type having at least one first electrode and one control electrode and a pair of second electrodes, the first and control electrodes thereof being electrically connected to said first terminal and to one of its second electrodes, respectively;

a plurality of designated transistors of the opposite conductivity type to that of said transistor pair means and each having first, second and control electrodes;

first means electrically connecting the first electrodes of first, second, third and fourth designated transistors to said third terminal and their control electrodes together, said first transistor's second electrode to one side of said resistor, and said second and third transistor's second electrodes to the control electrode of said transistor pair means;

a fifth designated transistor having its first electrode electrically connected to said second terminal and its second electrode electrically connected to the other side of said resistor and to the other second terminal of said transistor pair means;

a sixth designated transistor having second and control electrodes electrically connected to said first terminal and said other side of said resistor, respectively, and a first electrode electrically connected to the control electrode of said fifth transistor; and a seventh designated transistor having first and control electrodes electrically connected to the control and second electrodes of said first transistor and having its second electrode electrically connected to said sixth transistor's first electrode;

operation of said source establishing a voltage across said resistor that is substantially constant and independent of temperature variation for setting a reference current in the latter and said first transistor for requiring a current of a specified value in said fourth transistor which has a second electrode for electrical connection to a load.

10. The source according to claim 9 in which the voltage drop established between said third terminal and the one side of said resistor is substantially equal to and of opposite sense to the voltage drop established between said second terminal and the other side of said resistor.

11. The source according to claim 10 wherein one and other of the first and second electrodes are emitter and collector electrodes, and the control electrodes are base electrodes, the base-emitter junction of said fifth and sixth transistors being electrically connected in series between said second terminal and the other side of said resistor and poled in the same one direction; the base-emitter junctions of said first and seventh transistors being electrically connected in series between said third terminal and the one side of said resistor and poled in the same direction which is opposite to the one direction.

12. The source according to claim 11 wherein the current associated with the other second electrode of said transistor pair means is substantially twice the reference current.

13. The source according to claim 12 wherein said first and fifth transistors and said sixth and seventh transistors comprise pairs of designated transistors, the transistors in a given pair being matched and having collector currents of substantially the same values for causing the base-emitter junction voltages thereof to be substantially the same values.

14. The source according to claim 13 comprising start-up means electrically connected between said seventh transistor's second electrode and the control electrode of said transistor pair means.

15. The source according to claim 14 wherein said first means comprises an eighth designated transistor having first and second electrodes electrically connected in series in the electrical connection of said third transistor's second electrode to the control electrode of said transistor pair means, biasing of the control electrode of said eighth transistor controlling operation of the current source.

16. The current source according to claim 15 wherein said start-up means further comprises a ninth transistor having control and second electrodes electrically connected to the first and second electrodes, respectively, of said eighth transistor and having a first electrode electrically connected to said seventh transistor's second electrode.

* * * * *